United States Patent [19]

Titus

[11] Patent Number: 4,722,261

[45] Date of Patent: Feb. 2, 1988

[54] EXTENDABLE RAM CANNON

[75] Inventor: Richard R. Titus, South Glastonbury, Conn.

[73] Assignee: United Technologies Corporation, Hartford, Conn.

[21] Appl. No.: 909,803

[22] Filed: Sep. 22, 1986

[51] Int. Cl.[4] ..... F41F 17/00

[52] U.S. Cl. ..... 89/7; 89/8; 89/14.05; 89/16; 60/270.1

[58] Field of Search ..... 89/7, 8, 14.05, 14.2, 89/14.4, 16; 42/76.01, 79; 102/374, 376; 60/270.1

[56] References Cited

U.S. PATENT DOCUMENTS

| | | | |
|---|---|---|---|
| 3,126,789 | 3/1964 | Meyer | 89/8 |
| 3,229,583 | 1/1966 | Long et al. | 89/14.05 |
| 3,253,511 | 5/1966 | Zwicky | 89/8 X |
| 3,284,942 | 11/1966 | Moseley | 42/79 |
| 3,359,856 | 12/1967 | Grosschopf et al. | 89/16 |
| 3,465,638 | 9/1969 | Canning | 89/8 |
| 4,384,507 | 5/1983 | Finn | 89/14.4 |
| 4,428,293 | 1/1984 | Botwin et al. | 102/381 |

FOREIGN PATENT DOCUMENTS 2328810 1/1975 Fed. Rep. of Germany ..... 89/1.8

OTHER PUBLICATIONS

P. J. Wilbur et al., "The Electrothermal Ramjet", J. Spacecraft, vol. 20, No. 6, Nov.-Dec. 1983, pp. 603-610.

A. Hertzberg et al., "The RAM Accelerator . . . ", 37th Meeting of the Aeroballistic Range Assoc., Quebec, Canada, Sep. 9-12, 1986.

*Primary Examiner*—Stephen C. Bentley

*Attorney, Agent, or Firm*—William J. Sapone

[57] ABSTRACT

A ram cannon (1) has an extendable barrel (2) slidably disposed over a starter cannon barrel (7). Such an extendable barrel is fully retractable during transport of the cannon and extendable at the time of firing. The barrel is also partially extendable, thereby providing a means to vary the muzzle velocity of a projectile (6) without varying the ratio of the fuel to the oxidizer in the propellant mixture. Utilizing an extendable barrel allows adapting a ram cannon to mobile artillery weapons, providing ease in transport, setup and firing, with a precise and rapid range adjustment capability.

1 Claim, 6 Drawing Figures

EXTENDABLE RAM CANNON

DESCRIPTION

1. Technical Field

This invention relates to ram cannons and more particularly to a ram cannon which utilizes an extendable barrel to vary the muzzle velocity of a projectile accelerated therein.

2. Background Art

The ramjet principal of propulsion, used in aircraft and rocket engines, is well known. During the flight of a ramjet powered vehicle, high velocity air enters a diffuser in the front of a ramjet engine. The diffuser is shaped to slow the flowing air, thereby inducing compression of the airstream. This compressed air enters a combustion chamber into which fuel is continuously injected and ignited, producing hot combustion gases. Forward vehicle thrust is provided by the ejection of the hot combustion gases through a discharge nozzle at a velocity greater than the flight speed. Since a ramjet relies on high air flow velocity through a diffuser rather than mechanical apparatus to achieve compression, ramjets require minimum flight speeds of at least Mach 1.5 for efficient operation. Generally, chemical rocket motors or turbine type engines must be used to propel a ramjet-powered vehicle to such minimal flight speeds before ramjet propulsion is initiated.

Adapting the ramjet principal of propulsion to gun fired projectiles significantly increases the range of artillery and the destructive potential of anti-tank weapons. Conventional explosive propulsion generally accelerates a projectile to supersonic speeds between Mach 1.5–4.0. Ramjet propulsion extends the flight of a projectile by further accelerating such a projectile to hypersonic speeds (Mach 5.0 and above). Prior art weapons, utilizing the ramjet principle to boost projectile speed, have included various modified projectiles incorporating ramjet engines which initiate further acceleration after discharge from a conventional gun barrel. Such projectiles include an outer casing, inner compression and combustion chambers, an integral fuel supply and a discharge nozzle. U.S. Pat. No. 4,428,293 to Botwin et al discloses such a projectile which also includes variable thrust control of the projectile after discharge from a gun.

A ram cannon uses the ramjet principle to promote projectile acceleration before discharge from a gun barrel. By passing an explosively accelerated projectile through a barrel section containing a fuel-oxidizer mixture, the projectile and barrel, in effect, become a ramjet engine with the barrel effectively forming the outer engine casing and the spacing between the projectile and barrel wall defining the compression and combustion chambers. In a subsonic combustion ram cannon, a discharge nozzle is defined by the annular spacing between the projectile tail and the barrel wall. As the projectile passes through the barrel, the premixed fuel-oxidizer mixture is compressed and ignited, generating hot combustion gases which expand rearwardly through the discharge nozzle, imparting forward thrust to the projectile.

One use for a ram cannon is as an attachment to the barrel of a conventional cannon, which would extend the range of such a weapon without extensive modification to the cannon or firing system. One such barrel is disclosed in commonly assigned U.S. patent application Ser. No. 857,687 to Titus, which involves the use of an outwardly flared barrel bore, optimizing barrel length and weight. By outwardly flaring the bore, added barrel bore volume is provided which dissipates the pressure build-up of combustion gases by allowing radial as well as longitudinally rearward gas expansion. The outwardly flared bore provides nearly uniform forward thrust as the projectile accelerates through the barrel.

However, even with an optimized flared barrel, a 1.9 meter barrel attachment is required to ramjet accelerate a 37 mm projectile to a velocity of Mach 5.5. Such a long barrel extention is cumbersome to attach and would preclude practical utilization on mobile weapons systems such as self propelled artillery. In addition, a long barrel extension would have a detrimental effect on the barrel elevation mechanism conventially used for range control.

An aspect of particular importance to the utilization of a ram cannon is the method of varying the final projectile muzzle velocity. It would be advantageous to have a maximum degree of flexibility in determining the muzzle velocity of the projectile in order to controllably vary the range of the weapon for a given barrel elevation, with the higher muzzle velocities providing increased range. One method for accuratly targeting a projectile in intermediate ranges involves varying the fuel to oxidizer ratio in the barrel. By decreasing the amount of fuel in the barrel, combustion pressures will be reduced, reducing the acceleration of the projectile. Such a system would have to be highly complex to vary the fuel mixture between rapid firings, requiring separate storage of the fuel and oxidizer and integral mixing devices. Consequently, a need exists to develop a ram cannon which optimizes barrel length without compromising performance and which provides precise control of the projectile's final muzzle velocity without complex fuel mixing systems.

DISCLOSURE OF INVENTION

It is an object of the present invention to provide a ram cannon which achieves precise control of the projectile muzzle velocity without varying the ratio of fuel to oxidizer mixture within the barrel.

It is a further object of the present invention to provide a ram cannon adaptable to mobile weapons systems.

It is a further object of the present invention to provide a ram cannon in which the barrel is retractable for transport.

These and other objects of the present invention are achieved by providing an extendable ram cannon barrel which is slidably disposed over a starter cannon barrel and fully retractable thereon during transport to a firing site. When a target is identified, the barrel is extended, sealed and charged with a fuel-oxidizer mixture, with the extendable barrel locatable in intermediate extension lengths, calibrated to provide a desired muzzle velocity. Since the final velocity is determined by the amount of fuel consumed, varying the length of the barrel varies the quantity of fuel contained in the barrel, and therefore provides a measured amount of fuel at the intermediate extension lengths which controls the muzzle velocity of the projectile. Such an arrangement allows utilization of a standardized fuel oxidizer mixture, avoiding complex storage, feed and mixing systems, while providing ease in adjusting projectile range when firing from a barrel locked at an optimum elevation.

In a preferred embodiment, the extendable ram cannon barrel includes an outwardly flared bore, providing added barrel bore volume to dissipate the pressure build-up of combustion gases by allowing radial as well as longitudinally rearward gas expansion. In operation, a projectile is explosively accelerated in the cylindrically bored starter cannon to supersonic speed. The projectile then enters the ram cannon barrel by passing through a muzzle seal. As the projectile travels through the barrel, the fuel-oxidizer mixture contained therein is compressed and combusted between the projectile and barrel wall. The combustion gases are then expelled through a nozzle-like opening between the projectile tail section and the barrel wall, increasing the gas velocity above the flight speed, thereby imparting forward thrust and accelerating the projectile. By calibrating the barrel length to final muzzle velocity, based on the amount of fuel contained therein, precise ranging is achieved as the barrel can be quickly retracted or extended between firings.

BEST MODE FOR CARRYING OUT THE INVENTION

Figure 1:
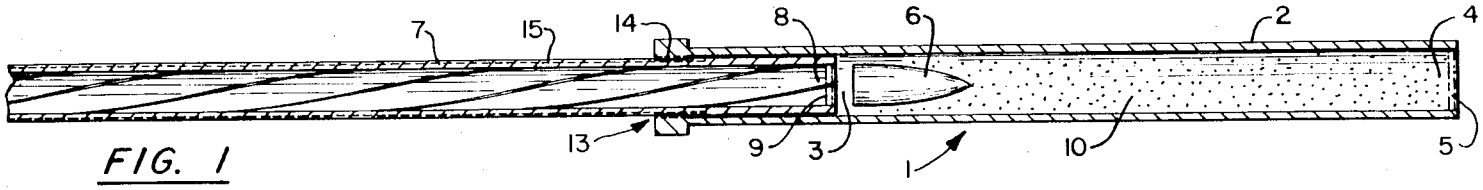
FIG. 1 is an elevation of the extendable ram cannon of the present invention in the fully extended position.

Referring to FIG. 1, the extendable ram cannon barrel 1 of the present invention has a barrel 2 which includes a breech end 3 and a muzzle end 4. The muzzle end 4 is provided with a muzzle seal 5, which may comprise a burst diaphragm which, when employed with suitable timing and actuation devices (not shown), is opened in flower-like fashion to allow uninterrupted travel of a projectile 6 through the barrel 2. The ram cannon barrel 2 is slidably disposed over a starter cannon barrel 7 which has a muzzle end 8 provided with a muzzle seal 9, similar to muzzle seal 5. Such seals allow containment of a fuel-oxidizer mixture 10, such as a hydrogen/oxygen mixture, within the ram cannon barrel. The inside diameter of the barrel 2 at the breach end 3 substantially matches the outside diameter of the starter cannon barrel 7. A seal 11, best seen in FIG. 4, prevents combustion gases from entering the retracted portion of the barrel 2.

Figure 2A:
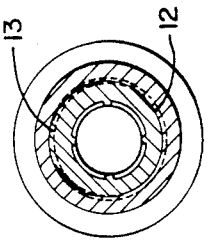
FIG. 2*a* is a cross sectional view of the ram cannon taken along line 2*a*—2*a* of FIG. 2.
Figure 2:
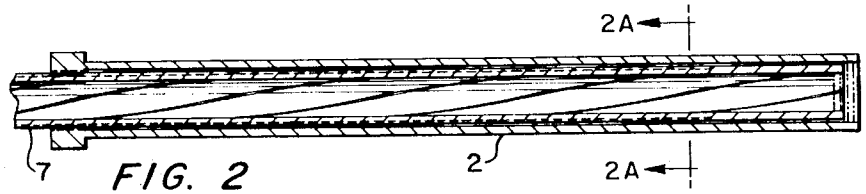
FIG. 2 is an elevation of the extendable ram cannon of the present invention in a fully retracted position.

Referring to FIG. 2, an embodiment of the extendable ram cannon is shown in the fully retracted position for ease in transport. Referring to FIG. 2*a*, engagement means are shown which illustrate the mating of the ram cannon barrel 2 with the starter barrel 7. Such means comprise spiral threads 12 in the breach end of the barrel 2 which mate with spiral threads 13 sculpted in the skin of the starter barrel 7. By rotating the ram cannon barrel, utilizing any adaptable rotating means, the ram cannon barrel is extended or retracted, varying the barrel length, and controlling the quantity of fuel in the barrel, thereby adjusting the projectile muzzle velocity. In addition, the threaded engagement means also act as a secondary sealing arrangement should the seal 11 fail.

Figure 3:
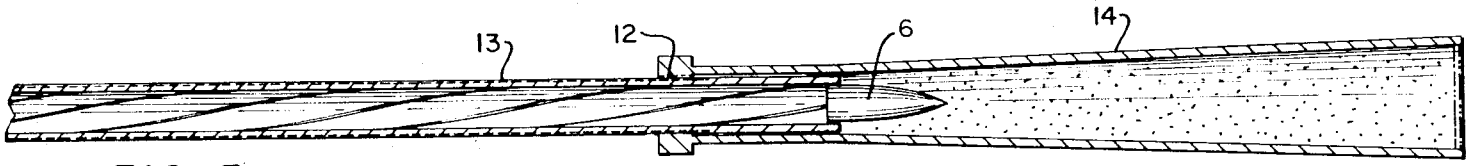
FIG. 3 is a schematic representation of a projectile accelerating through an alternative embodiment of the ram cannon of the present invention in the fully extended position.
Figure 4:
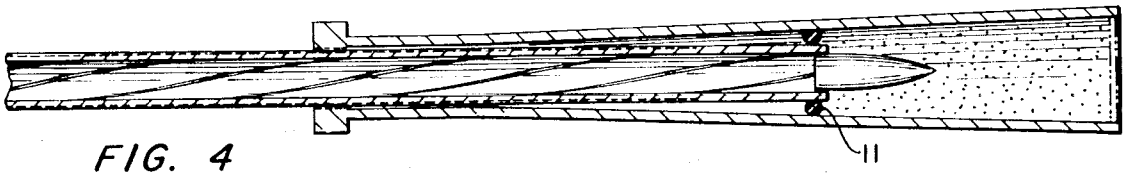
FIG. 4 is a schematic representation of a projectile accelerating through an alternative embodiment of the ram cannon of the present invention in a partially retracted position.

Referring to FIGS. 3 and 4, the slidable ram cannon barrel of the present invention is shown with a ram cannon barrel 14 which has an outwardly flared bore, from the breech end to the muzzle end, of constantly increasing bore diameter, in two positions, fully extended and partially retracted. Such a flared ram cannon barrel is described in pending U.S. patent application Ser. No. 857,687, titled "Ram Cannon Barrel", filed by R. R. Titus, who is also the applicant for the present invention, on Apr. 31, 1986, which is hereby incorporated by reference.

By outwardly flaring the bore, added area between the barrel and projectile is provided which dissipates the pressure build-up of combustion gases by allowing radial as well as longitudinally rearward gas expansion. The outwardly flared bore also provides nearly uniform fuel compression as the projectile travels through the ram cannon barrel. Since the bore diameter increases from breech end to muzzle end, the spacing between the projectile and the barrel wall similarly increases, providing a gradually enlarging fuel-oxidizer compression zone and nozzle opening area. However, since the projectile is continuously accelerating through the barrel, and an increase in speed causes an increase in inlet, combustion and exhaust pressure in a ramjet engine, the otherwise decreased efficiency due to the enlarged compression zone and nozzle opening area is effectively offset by the increased operating pressure. Thus, nearly uniform forward thrust is achieved as the projectile accelerates through the barrel. Such nearly uniform fuel compression and controlled radial expansion of the combustion gases moderate the combustion pressure build-up within the barrel to acceptable levels without necessitating extensive modification of either the cannon or the projectile. While the invention is described in relation to a flared barrel, it will be understood by those skilled in the art that any barrel of suffient diameter to allow slidable engagement over a starter cannon barrel could be used.

Referring to FIG. 3, the projectile 6 is shown having just entered the ram cannon barrel 15 by passing through the starter cannon muzzle seal 9, initiating compression and ignition of the fuel-oxidizer mixture 10 which is contained within the sealed ram cannon barrel 14. At this point, ramjet propulsion of the projectile 6 is initiated. The minimum initial barrel bore diameter provided by the maximum extension of the barrel, maximizes the initial combustion gas pressure, thereby optimizing propulsion efficiency. The projectile 6 then passes through the barrel 14 consuming the fuel-oxidizer mixture 10, generating hot combustion gases which accelerate the projectile through the barrel.

Referring to FIG. 4, the projectile 6 has just entered the ram cannon barrel 14 which is in a partially retracted position. The retraction of the barrel reduces the amount of the fuel-oxydizer in the barrel and increases the spacing between the projectile and barrel wall, decreasing propulsion efficiency. The seal 11, which may be an expandable type seal, prevents fuel or combustion gases from entering the retracted portion of the barrel.

Figure 5:
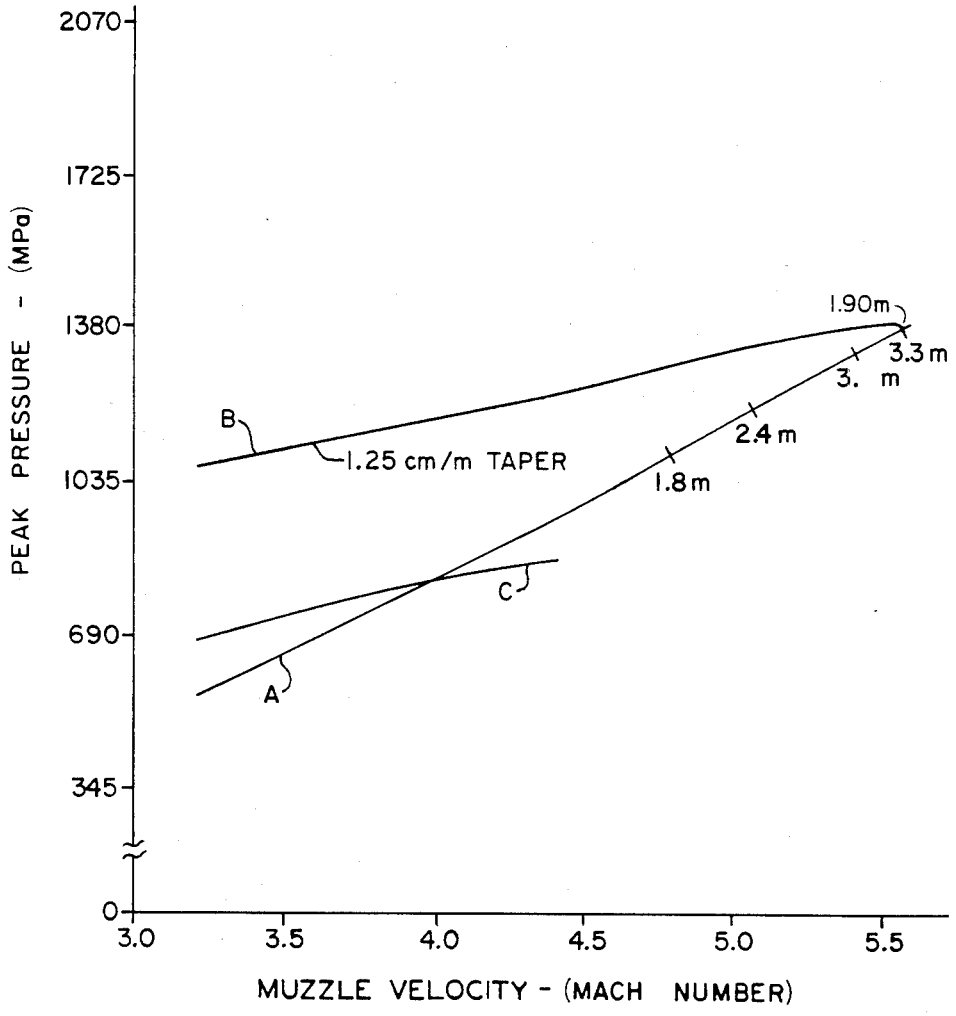
FIG. 5 is a graphical representation of the peak pressure versus muzzle velocity for various barrel lengths.

Referring to FIG. 5, a graphical representation of peak barrel pressure during ramjet acceleration versus velocity (Mach number) is shown for a 37 mm projectile. For illustrative purposes, assume it is desired to accelerate a 37 mm projectile to a maximum speed of Mach 5.5. A 37 mm projectile would normally be fired through a starter cannon having a 40 mm diameter barrel. To achieve ramjet acceleration, a 55mm constant diameter slidable barrel must be disposed over the starter cannon barrel, which would be approximately 3.35 m (132 inches) long when fully extended (see line A). By utilizing an outwardly flared bore (see line B), having a linear increase in bore diameter, increasing outwardly at a rate of 1.25 cm per linear meter (0.15 inches per linear foot), the desired maximum muzzle velocity of Mach 5.5 could be achieved without exceeding the working pressure limit and with a final barrel length of 1.9 m (75 inches), only slightly more than one-half the length of the 55 mm barrel.

For targeting in intermediate ranges, utilizing an extendable barrel, the entire ram cannon barrel is partially extended to a calibrated length. Referring to FIG. 5, three curves are shown depicting peak pressure versus projectile muzzle velocity for various barrels, with each curve representing the projectile velocity as it travels through the ram cannon barrel, from entrance to exit. Curve A depicts the fully extended constant diameter barrel, curve B, the fully extended flared barrel, and curve C, the partially extended flared barrel. Curve A details the final muzzle velocity achievable by varying the length of a constant diameter (55 mm) ram cannon barrel, illustrating a linear relationship between length and speed.

From curves B and C, it is seen that a change in barrel length has a non-linear effect on projectile velocity due to the non-linear change in barrel bore volume. Retracting the flared barrel increases the initial projectile to barrel wall spacing, thereby lowering the peak pressure at ramjet initiation. This provides increased sensitivity to slight changes in length, with a small change in barrel length producing a large change in muzzle velocity. Such a combination provides a precise and rapid range adjustment capability which is much more easily calibratable than varying the fuel to oxidizer ratio in the propellant mixture.

While a ram cannon barrel adapted for use as an attachment slidably disposed over a cannon barrel is discussed, it will be understood by those skilled in the art that this invention is applicable to any weapon incorporating ramjet propulsion of a projectile within a barrel. While the preferred embodiment of the present invention is described in relation to an outwardly flared barrel bore having a constantly increasing bore diameter, it will be understood by those skilled in the art that modification in the bore taper, barrel type, sealing means, attaching means, bore surfacing, or projectile shape can be made without varying from the present invention.

Having thus described the invention, what is claimed is:

1. A ram cannon of the type adapted for accelerating a projectile therethrough in accordance with ramjet principles, said cannon including a barrel having a bore with a breech end and a muzzle end, and means for sealing said barrel ends, wherein said projectile is accelerated to ramjet takeoff velocity in a starter cannon, entering said ram cannon by passing through said sealed breech end, compressing and combusting a fuel-oxidizer mixture contained within said barrel, such that the gas generated by said combustion further accelerates said projectile through said barrel, the improvement characterized by:

said barrel being slidably disposed over said starter cannon and variably locatable thereon, to control the amount of said fuel-oxidizer contained therein, such that said projectile is variably acceleratable therein, said barrel comprising a flared barrel which has a barrel bore increasing in diameter from said breech end to said muzzle end.

* * * * *